US005447540A

United States Patent [19]

Kobayashi et al.

[11] Patent Number: 5,447,540

[45] Date of Patent: Sep. 5, 1995

[54] METHOD OF DYEING A HIGH HEAT-RESISTANT SYNTHETIC FIBER MATERIAL

[75] Inventors: Shigenobu Kobayashi, Toyonaka; Tetsuo Okamoto, Kawasaki, both of Japan

[73] Assignee: Teijin Limited, Osaka, Japan

[21] Appl. No.: 207,271

[22] Filed: Mar. 7, 1994

Related U.S. Application Data

[63] Continuation-in-part of Ser. No. 11,388, Jan. 29, 1993, abandoned.

[30] Foreign Application Priority Data

Jan. 30, 1992 [JP] Japan ..... 4-015017
Sep. 25, 1992 [JP] Japan ..... 4-256609

[51] Int. Cl.[6] ..... D06P 5/00; D06P 5/20
[52] U.S. Cl. ..... 8/654; 8/934; 8/662; 8/925
[58] Field of Search ..... 8/654, 662, 925, 934

[56] References Cited

U.S. PATENT DOCUMENTS 4,883,496 11/1989 Ghorashi ..... 8/476

FOREIGN PATENT DOCUMENTS 52-25178 2/1977 Japan .
61-275487 12/1986 Japan .
63-256765 10/1988 Japan .
1111014 4/1989 Japan .
241414 2/1990 Japan .
376868 4/1991 Japan .
1244255 8/1971 United Kingdom .

OTHER PUBLICATIONS

Color Index, Society of Dyers and Colorists, 1971 p. 4405.
Office Action for Taiwan Patent Office Mar. 1995.
Moore et al, "Dyeability of Nomex Aramid Yarn" Textile Research Journal, Aug. 1985.

*Primary Examiner*—Paul Lieberman
*Assistant Examiner*—Margaret Einsmann
*Attorney, Agent, or Firm*—Burgess, Ryan & Wayne

[57] ABSTRACT

A high heat-resistant synthetic fiber material containing, for example, aramid, PEEK, or PEN fibers, that can be dyed uniformly at a high color density, with a dye dissolved or dispersed in a liquid medium, for example, water, and having a molecular weight of 330 to 400, at a dyeing temperature of 150° C. or more within a closed system.

5 Claims, No Drawings

METHOD OF DYEING A HIGH HEAT-RESISTANT SYNTHETIC FIBER MATERIAL

CROSS-REFERENCE TO RELATED APPLICATION

This application is a continuation-in-part application of Ser. No. 08/011,388, filed on Jan. 29, 1993 now abandoned.

BACKGROUND OF THE INVENTION

1. Field of the Invention

The present invention relates to a method of dyeing a high heat-resistant synthetic fiber material. More particularly, the present invention relates to a method of dyeing a high heat-resistant synthetic fiber material at an enhanced leveling and in a high dye-adsorption so as to provide a dyed fiber material having a significantly improved washing fastness.

2. Description of the Related Art

It is well known that synthetic fiber materials, for example, fabrics, are employed not only for various types of clothes but also for various types of industrial materials. Almost all of the synthetic fiber materials are colored. Also, a major portion of the colored fiber materials are produced by dyeing the fiber materials with a dye, whereas a minor portion of the colored fiber materials are produced from synthetic polymer material mixed with a pigment.

Further, it is known that the synthetic fiber material having a high heat-resistant, for example, wholly aromatic polyamide (aramid) fibers, wholly aromatic polyester fibers, polyetheretherketone (PEEK) fibers, polyphenylenesulfide (PPS) fibers, polyethersulfone (PPS) fibers, polyethersulfone (PES) fibers and polyetherimide (PEI) fibers, have a dense fiber structure and thus are very difficult to dye with a dye in a usual dyeing manner. Therefore, the high heat-resistant synthetic fiber materials are usually employed only as industrial materials. In other words, a high degree of difficulty in dyeing is one of the reasons that the high heat-resistant synthetic fiber materials cannot be used for clothes.

To reduce the difficulty in dyeing, JP-A-52-25,178 provides a new method in which an aramid fiber material is pretreated with an organic polar solvent, for example, dimethyl sulfone, and then dyed with a dye. Also, JP-A-62-268,877 provides a new method in which an aramid fiber material is dyed with a dye, which being heated in an organic polar solvent. Further, JP-A-2-99,674 discloses a new high temperature dyeing method in which a polyetherimide (PEI) fiber material is dyed at a temperature of 135° C to 140° C. The above-mentioned new methods are unsatisfactory in that the dye can be adsorbed only in the surface portions of the fibers and thus in the form of a ring, and the dyed fiber material exhibits a poor washing fastness. Also, when the organic polar solvent is employed, the waste water discharged from the dyeing process pollutes the environment.

JP-A-63-256,765 discloses a dyeing method in which an aramid fiber material is dyed with a dye in a vacuum, under which the aramid fibers are swollen.

JP-A-1-111,014 and JP-A-2-41,414 discloses a dyeing method in which a dye or pigment is dispersed in a spinning dope solution of an aramid polymer and this dye or pigment-colored dope solution is subjected to a wet spinning process.

JP-A-3-76,868 discloses a process for producing a poly(p-phenylene-terephthalamide) (PPTA) fiber capable of being dyed with cationic dyes, by immersing a PPTA fiber in an aqueous sulfuric acid solution and then bringing the sulfuric acid-treated PPTA fiber into contact with a specific dyeing promoter.

The above-mentioned methods are unsatisfactory in that they can be utilized only for a limited color range, the reproducibility in dyeing is poor and the light fastness of the dyed fiber material is low.

U.K. Patent No. 1,244,255 discloses a method of drying a heat-resistant fiber material with a disperse dye in an aqueous dyeing medium at a high temperature of 170° C. to 260° C. In this method as disclosed, a disperse dye having a low molecular weight of 314 or less was employed to enhance dye adsorption by the fiber material. This method is, however, disadvantageous in that the dye adsorbed by the fiber material is easily removed by washing and readily faded by light, namely the dyed fiber material exhibits a poor washing fastness and light fastness.

SUMMARY OF THE INVENTION

An object of the present invention is to provide a method of dyeing a high heat-resistant synthetic fiber material with an enhanced leveling and a high dye-adsorption, so as to produce a dyed high heat-resistant synthetic fiber material having an excellent washing fastness and light fastness.

The inventor of the present invention studied new dyeing methods for the high heat-resistant synthetic fiber material and found that when dyed with a specific dye dissolved or dispersed in a liquid medium and having a relatively low specific molecular weight, the dye can penetrate the inside of the high heat-resistant synthetic fibers, and thus the resultant dyed fiber material is capable of having a high color depth and a satisfactory washing fastness and light fastness, which could not be obtained by any prior arts.

Namely, the above-mentioned object can be attained by the dyeing method of the present invention in which a high heat-resistant synthetic fiber material is brought into contact with a dye, dissolved or dispersed in a liquid medium, comprising at least one dye compound with a molecular weight of 330 to 400 at a dyeing temperature of 150° C. or more within a closed system.

Preferably, the dye compound exhibits a spectral transmission loss of 20% or less, determined in such a manner that the dye is dissolved or dispersed at a concentration of 0.2% by weight in water; the pH of the resultant aqueous dye solution or dispersion was adjusted to a level of from 4 to 5 by adding an aqueous acetic acid solution thereto to provide an original aqueous dye solution or dispersion; the original aqueous dye solution is diluted with water in the same volume as that of the original aqueous dye solution or the original aqueous dye dispersion is diluted with acetone in the same volume as that of the original aqueous dye dispersion and the dispersed dye is dissolved in the resultant water-acetone mixture; the resultant diluted original aqueous dye solution is subjected to a measurement of a spectral transmittance To thereof in % at a wave length at which the diluted original dye solution exhibits a minimum spectral transmission; separately the original aqueous dye solution or dispersion is heat-treated in a closed system at a temperature of 150° C. for 60 minutes; the resultant heat-treated aqueous dye solution is diluted with water in the same volume as that of the heat-treated aqueous dye solution or the heat-treated aqueous dye dispersion is diluted with acetone in the same volume as that of the heat-treated aqueous dye dispersion and the dispersed dye is dissolved in the resultant water-acetone mixture; the resultant heat-treated, diluted aqueous dye solution is subjected to a measurement of a spectral transmittance Tt thereof in % at a wave length at which the heat-treated, diluted dye solution exhibits a minimum spectral transmission; and the spectral transmission loss STL in % of the dye is calculated from the measured To and Tt in accordance with the equation (I):

$$STL\ (\%)=(To-Tt)/(100-To)\times 100 \quad \text{(I).}$$

DESCRIPTION OF THE PREFERRED EMBODIMENTS

The high heat-resistant synthetic fibers to which the dyeing method of the present invention are applied have a long-term heat resistive temperature of 120° C. or more, determined in accordance with UL746B, and preferably selected from the group consisting of wholly aromatic polyamide fibers, wholly aromatic polyester fibers, polyetheretherketone (PEEK) fibers, polyphenylenesulfide (PPS) fibers, polyethersulfone (PES) fibers and polyetherimide (PEI) fibers. Most preferable high heat-resistant synthetic fibers are wholly aromatic polyamide (aramid) fiber.

The high heat-resistant synthetic fibers optionally contain an additive comprising at least one member selected from the group consisting of stabilizers, antioxidants, flame retardants, antistatic agents, fluorescent brightening agents, catalysts, coloring agents, and inorganic particles, as long as it does not hinder the attainment of the object of the present invention.

The high heat-resistant synthetic fiber material may be in any form, for example, fiber mass, yarns, for example, staple fiber-spun yarns, multifilament yarns, and monofilament yarns, and fabrics, for example, woven fabrics, knitted fabrics and nonwoven fabrics.

In the fiber material, the high heat-resistant synthetic fibers may be blended, blend-spun, union-woven or union-knitted with other fibers including natural fibers, for example, cotton fibers, regenerated fibers, for example, rayon fibers, and synthetic fibers, for example, polyester fibers.

The dyes usable for the method of the present invention are preferably selected from the group consisting of disperse dyes, cationic dyes, vat dyes, naphthol dyes, acid dyes and mordant dyes, which should comprise at least one dye compound having a molecular weight of 330 to 400, and, preferably exhibit a spectral transmission loss of 20% or less in water at a temperature of 150° C.

Also, the dyeing procedure for the high heat-resistant synthetic fiber material with the aqueous solution of the specific dye must be carried out at a temperature of 150° C. or more.

If the molecular weight of the dye compound is less than 330, although the degrees of diffusion and penetration of the dye into the fiber are high, the resultant dyed fiber material exhibits a poor washing fastness and light fastness, because the low molecular weight dye is easily desorbed and faded.

If the molecular weight of the dye compound is more than 400, it is difficult for the dye to satisfactorily penetrate the inside of the fibers even when the dyeing procedure is carried out at a temperature of 150° C. or more.

Also, if the spectral transmission loss of the dye in water at a temperature of 150° C. is more than 20%, the dyeing procedure at a temperature of 150° C. or more sometimes causes the dye to deteriorate or change in dyeing color, and thus it is difficult to dye the fiber material to a desired color.

The dye solution or dispersion in a liquid medium comprises the specific dye alone, or together with another dye, an ultraviolet ray-absorber, and/or an antioxidant.

If necessary, the high heat-resistant synthetic fiber material is scoured and heat-treated before the dyeing procedure.

In the method of the present invention, the high heat-resistant synthetic fiber material is treated in a solution or dispersion of the specific dye in a liquid medium at a temperature of 150° C. or more, preferably 160° C. or more, more preferably 160° C. to 250° C., in a closed system, for example, a closed dyeing machine.

If the dyeing temperature is less than 150° C., it is difficult for the specific dye to satisfactorily penetrate the inside of the fibers and for the dyed fiber material to obtain a desired high color depth and washing fastness, even when the dye satisfies the above-mentioned molecular weight and spectral transmission loss.

By carrying out the dyeing procedure at a temperature of 150° C. or more, preferably 160° C. or more, the dye is satisfactorily diffused throughout the inside of the fibers and the fixed dye in the fibers exhibits a high washing fastness and light fastness. However, an excessively high dyeing temperature sometimes causes the fiber material to deteriorate and exhibit reduced physical properties. Therefore, the dyeing temperature is preferably not more than 250° C.

In the method of the present invention, the liquid medium consists of at least one liquid compound that does not dissolve or decompose the high heat-resistant synthetic fiber material at the dyeing temperature. The most preferable liquid medium for the method of the present invention is water that can be easily handled during the dyeing procedure when the liquid medium consists of water that has a boiling point of 100° C. under one atmosphere pressure. Therefore, the dyeing procedure in the aqueous medium must be carried out within a closed high pressure system, for example, a closed high pressure dyeing machine.

The dyeing machine usable for the method of the present invention must have a high pressure resistance, preferably under 25 atmospheres or more.

There is no restriction in dye concentration in the liquid medium and in the dyeing time. Preferably, the concentration of the dye is in the range of from 0.1 to 50% by weight and the dyeing time is from 15 to 150 minutes. After the dyeing procedure is completed, the dyed fiber material is subjected to an after-treatment, for example, reduction cleaning or heat treatment in the usual manner, if necessary.

In an embodiment of the method of the present invention, the high heat-resistant synthetic fiber material comprises wholly aromatic polyamide (aramid) fibers and the dyeing temperature is controlled to a level of 160° C. or more.

Preferably, the wholly aromatic polyamide fibers comprise a copolymer consisting of recurring p-phenyleneterephthalamide units of the formula:

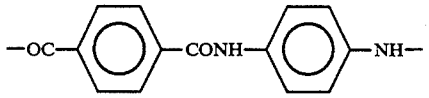

and recurring 3,4'-oxydiphenyleneterephthalamide units of the formula:

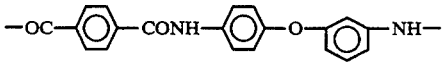

The above-mentioned aramid copolymer fibers are available under the trademark TECHNORA, from Teijin. This aramid copolymer molecules have a backbone chain having rigid p-phenylene groups and a soft diphenylether group, and thus the resultant aramid copolymer fibers exhibit a high disability under the dyeing conditions as defined in the present invention.

Another type of aramid polymer composed of rigid p-phenyleneterephthalamide units, another para-aromatic cyclic structure and/or aromatic cyclic structures having valence-bonds extending parallel to the molecular axis of the aromatic cyclic structure, has a high molecular coagulating force and thus the rigid structural fibers formed by a coagulating step have a high degree of crystallinity and a dense structure. Therefore, it is difficult for the dye to penetrate the inside of the fibers.

Compared to the rigid aramid fibers, the semi-soft aramid fibers having a soft diphenyl ether structure have a specific crystalline structure in which a plurality of small crystals are combined with each other and thus allow the dye to diffuse into the inside of the fibers when the fibers are heated in a liquid medium at a temperature of 150° C. or more, preferably 160° C. or more. Also, the semisoft aramid fibers having a soft structure can be drawn at a high draw ratio after coagulation, and thus have a high degree of orientation. These semisoft aramid fibers have high structural stability, and therefore, even when heated at a high temperature of 160° C. or more during the dyeing procedure, the semisoft fibers exhibit a higher resistance to thermal deterioration than that of usual rigid aramid fibers.

The aramid fibers and the wholly aromatic polyester fibers are usually capable of being dyed with disperse dyes. The disperse dyes have poor solubility in water and thus are used as a dispersion agent in an aqueous dyeing medium. The disperse dyes include benzene azo dye compounds (for example, monoazo and disazo dye compounds), heterocyclic azo dye compounds (for example, thiazole azo, benzothiazolazo, quinolinoazo, pyrizoneazo, imidazoleazo, and thiopheneazo dye compounds), anthraquinone dye compounds and condensed dye compounds (for example, quinophthalene, styryl and coumarin dye compounds).

Preferable disperse dyes are anthraquinone dyes and quinophthaline dyes that have a high light fastness.

In the dyeing method of the aramid fiber material, the dyeing temperature is controlled to 160° C. or more, preferably 170° C. or more. The dyeing rate of the aramide fiber material is enhanced with a raise in the dyeing temperature. However, the excessively high dyeing temperature causes the aramid fiber material and the dye to deteriorate or decompose. Therefore, the dyeing temperature for the aramid fiber material is preferably in the range of from 160° C. to 220° C., more preferably from 170° C. to 200° C.

When the aramid fibers are heated at the dyeing temperature in the aqueous dyeing medium, molecular movement in the fine crystalline regions are promoted so as to allow the dye particles to penetrate and diffuse inside the fibers. When the aramid fiber material is cooled, the five crystalline structure is returned to the initial dense structure. Therefore, the dye particles contained inside the fibers are sealed within the fibers and thus the dyed aramid fiber material exhibits an excellent washing fastness and light fastness.

EXAMPLES

The present invention will be further explained using the following examples.

In the examples, the following test was carried out.

(1) Spectral transmission loss STL of a dye

This test was carried out us follows:

A dye is dissolved or dispersed at a concentration of 0.2% by weight in water. The pH of the aqueous dye solution or dispersion was adjusted to a value of from 4.0 to 5.0 by adding an aqueous solution of acetic acid thereto.

The original aqueous dye solution was diluted with water in the same volume as that of the original aqueous dye solution, or the original aqueous dye dispersion was diluted with acetone in the same volume as that of the original aqueous dye dispersion and the dispersed dye is dissolved in the resultant water-acetone mixture.

The resultant diluted original aqueous dye solution was subjected to a measurement of a spectral transmittance To in % at a wave length at which the diluted original aqueous dye solution exhibited a minimum spectral transmission.

This original aqueous dye solution or dispersion was heat-treated in a closed, pressure-resistant stainless steel autoclave at a temperature of 150° C. for 60 minutes.

The heat-treated aqueous dye solution was diluted with water in the same volume as that of the heat-treated aqueous dye solution, or the heat-treated aqueous dye dispersion was diluted with acetone in the same volume as that of the heat-treated aqueous dye dispersion and the dispersed dye is dissolved in the resultant water-acetone mixture.

The resultant heat-treated, diluted aqueous dye solution was subjected to a measurement of a spectral transmittance Tt thereof in % at a wave length at which the heat-treated, diluted aqueous dye solution exhibited a minimum spectral transmission.

The measurement of the spectral transmissions To and Tt was effected using an automatic spectrophotometric recorder (Type 330) made by Hitachi Seisakusho.

The spectral transmission loss STL in % of the dye was calculated from the measured values To and Tt in accordance with the equation (I):

$$STL\ (\%) = (To - Tt)/(100 - To) \times 100 \quad \text{(I)}$$

(2) Degree of dyeability (K/S value)

By using Macbeth Color-Eye Model M-2020PL, (trademark) a dyed specimen was placed on white paper and the light reflection R of the dyed specimen was measured at a wave length at which the dyed specimen exhibited a minimum absorption of light.

The K/S value of the dyed specimen was calculated from R in accordance with the Kubelka-Munk equation (II):

$$K/S=(1-R)^2/2R$$

The larger the value of K/S, the higher the color depth (darkness) of the dyed specimen.

(3) Washing fastness

The washing fastness of the dyed specimen was determined in accordance with JIS L 0844-1973, Method A-2. In this washing fastness test, a white nylon 6 fabric and a white cotton fabric were attached to the dyed specimen in accordance with JIS L 803-1980.

(4) Light fastness

The light fastness of the dyed specimen was determined using a Eys-Super UV Tester (Trademark: Model. SUV-W13, made by Iwasaki Electronic Co., Ltd.). The dyed specimen was exposed to ultraviolet ray irradiation at a black panel temperature of 89° C. at a relative humidity of 50% for 2 hours. The degree of fading of the dyed specimen was observed visually and evaluated in the following five classes.

| Class | Observation result |
|---|---|
| 5 | No fading was recognized |
| 4 | Slightly faded |
| 3 | Faded |
| 2 | Significantly faded |
| 1 | Substantially no color was recognized |

Examples 1 to 4

In each of the examples, a plain weave was prepared from copoly(p-phenylene-3,4'-oxidiphenylene terephthalamide) (aramid) multifilament yarns having a yarn count of 1000 deniers/667 filaments (which are available under the trademark of TECHNORA, from Teijin) using a Lepia weaving machine.

The resultant aramid woven fabric had a warp and weft density of 31 yarns/25.4 mm, a basis weight of 8 g/m$^2$ and a thickness of 0.356 mm.

The aramid woven fabric was scoured in a scouring aqueous solution containing 1 g/liter of a nonionic detergent available under the trademark of SCOUROL 400, from Kao, and 0.5 g/liter of sodium carbonate, at a temperature of 90° C. for 20 minutes, and dried and heat-treated at a temperature of 190° C. for 2 minutes.

The resultant aramid woven fabric was immersed and dyed in an aqueous dye dispersion having the following composition:

| | |
|---|---|
| Disperse dye (as indicated in Table 1) (*)1 | 2% owf |
| Acetic acid | 0.2 ml/liter |
| Dispersing and leveling agent (*)2 | 0.5 g/liter |
| Liquor ratio: | 1:10 |

Note:
(*)1 Dye (1) CI Disperse Blue 56 having a molecular weight of 349 and an STL of 17%, and available under the trademark of Resoline Blue FBL.
Dye (2) CI Disperse Red 60 having a molecular weight of 331 and an STL of 2%, and available under the trademark of Resoline Red FB.
(*)2 Available under the trademark of Disper VG, from Meisei Kayaku.

During the dyeing procedure, the aqueous dye dispersion was heated at a temperature-raising rate of 2° C./minute from room temperature to 170° C. or 190° C. and then maintained at a temperature of 170° C. or 190° C. as indicated in Table 1, for 60 minutes. The dyed woven fabric was subjected to a reduction cleaning procedure to remove a dye fraction adhered to the surfaces of the fibers. The reduction cleansing solution had the following composition:

| | |
|---|---|
| Caustic Soda (flake) | 2 g/liter |
| Hydrosulfite | 2 g/liter |
| Nonionic detergent (*)3 | 2 g/liter |
| Temperature: | 80° C. |
| Time: | 20 minutes |

Note:
(*)3 Available under the trademark of Amiradine D, from Daiichi Kogyo-seiyaku.

The test results are shown in Table 1.

Comparative Examples 1 and 2

In each of the comparative examples, the same procedures as in Example 1 were carried out except that the dye was placed by CI Disperse Red 127 having a molecular weight of 431 and an STL of 10%, and the dyeing temperature was as indicated in Table 1.

TABLE 1

| Example | Item No. | Type of fibers | Type of dye | Dyeing temperature (°C.) | K/S value | Washing fastness | Light fastness |
|---|---|---|---|---|---|---|---|
| Example | 1 | Technora | CI Disperse Blue 56 | 170 | 4.6 | 5 | 5 |
| | 2 | " | CI Disperse Blue 56 | 190 | 5.7 | 5 | 5 |
| | 3 | " | CI Disperse Red 60 | 170 | 3.0 | 5 | 5 |
| | 4 | " | CI Disperse Red 60 | 190 | 4.3 | 5 | 5 |
| Comparative Example | 1 | " | CI Disperse Red 127 | 170 | 1.3 | 5 | 1 |
| | 2 | " | CI Disperse Red 127 | 190 | 2.0 | 5 | 1 |

Example 5

The same procedures as in Example 1 were carried out with the following exceptions.

(1) The copoly(p-phenylene-3,4'-oxidiphenylene terephthalamide) multifilament yarns (Technora) having a yarn count of 1000 deniers/667 filaments were knitted into a tubular knitted fabric using a 20 gage-tubular knitting machine (trademark: Model TN-21, made by Koike Seisakusho)

(2) The knitted fabric was placed together with an aqueous dye dispersion in a stainless steel vessel having a pressure resistance of 25 atmospheres or more.

The aqueous dye dispersion had the following composition.

| | |
|---|---|
| CI Disperse Blue 56 | 6% owf |
| Disper VG | 0.5 g/liter |
| Acetic acid | 0.2 ml/liter |
| Liquor ratio: | 1:40 |

After sealing, the stainless steel vessel was placed in a heating silicone oil bath, heated in the heating bath at a temperature-raising rate of 2° C./minute from room temperature to 170° C. and maintained at 170° C. for 60 minutes, while shaking so as to obtain uniform dyeing of the knitted fabric.

(3) The dyed knitted fabric was reduction-cleansed in the same manner as in Example 1.

The test results are shown in Table 2.

Example 6

The same procedures as in Example 5 were carried out except that the dyeing temperature was changed from 170° C. to 190° C.

The test results are shown in Table 2.

Example 7

The same procedures as Example 5 were carried out except that the aramid yarns were replaced by polyphenylenesulfide multifilament yarns having a yarn count of 1000 deniers/360 filaments.

The test results are shown in Table 2.

Comparative Example 3

The same procedures as in Example 5 were carried out except that the dyeing temperature was changed from 170° C. to 130° C.

The test results are shown in Table 2.

Comparative Example 4

The same procedures as in Example 5 were carried out except that the CI Disperse Blue 56 was replaced by CI Disperse Blue 165 having a molecular weight of 405 and an STL of 5% and which is available under the trademark of Resoline Blue BBLS.

The test results are shown in Table 2.

Comparative Example 5

The same procedures as in Example 5 were carried out except that the CI Disperse Blue 56 was replaced by CI Disperse Blue 19 having a molecular weight of 314 and an STL of 19% and which is available under the trademark of Serisol Fast Blue BRL.

The test results are shown in Table 1.

Example 8

The same procedures as in Example 5 were carried out with the following exceptions.

(1) The CI Disperse Blue 56 was replaced by CI Disperse Red 60 having the molecular weight and the STL as shown in Table 2.

(2) The dyeing temperature was changed from 170° C. to 175° C.

The test results are shown in Table 2.

Example 9

The same procedures as in Example 8 were carried out with the following exception. The dyeing temperature was changed from 175° C. to 190° C.

The test results are shown in Table 2.

Example 10

The same procedures as in Example 5 were carried out with the following exception.

The aramid (Technora) yarns were replaced by polyetheretherketone (PEEK) yarns each composed of parallel five PEEK multifilament yarns having a yarn count of 200 deniers/48 filaments.

The test results are shown in Table 2.

Example 11

The same procedures as in Example 5 were carried out with the following exceptions.

(1) The aramid (Technora) yarns were replaced by polyetherimide (PEI) yarns each composed of parallel five PEI multifilament yarns having a yarn count of 200 deniers/18 filaments.

(2) The dyeing temperature was changed from 170° C. to 155° C.

The test results are shown in Table 2.

Example 12

The same procedures as in Example 5 were carried out with the following exceptions.

(1) The aramid (Technora) yarns were replaced by polyethylenenaphthalate (PEN) yarns each composed of four parallel PEN multifilament yarns having a yarn count of 258 deniers/48 filaments.

(2) The dyeing temperature was changed from 170° C. to 155° C.

The test results are shown in Table 2.

Example 13

The same procedures as in Example 5 were carried out with the following exceptions.

(1) The Technora yarns were replaced by para-type aramid multifilament yarns having a yarn count of 1500 deniers/1000 filaments and available under the trademark of Kevler 119, from Du Pont.

(2) The dyeing temperature was changed from 170° C. to 185° C. The

The test results are shown in Table 2.

Example 14

The same procedures as in Example 13 were carried out with the following exception.

The CI Disperse Blue 56 was replaced by CI Disperse Red 60 having the molecular weight and the STL as shown in Table 2.

The test results are shown in Table 2.

Comparative Example 6

The same procedures as in Example 5 were carried out with the following exception.

The dyeing temperature was changed from 170° C. to 140° C.

The test results are shown in Table 2.

Comparative Example 7

The same procedures as in Comparative Example 6 were carried out with the following exception.

The CI Disperse Blue 56 was replaced by CI Disperse Red 60 having the molecular weight and the STL as shown in Table 2.

The test results are shown in Table 2.

Comparative Example 8

The same procedures as in Example 7 were carried out with the following exception.

The dyeing temperature was changed from 170° C. to 140° C.

The test results are shown in Table 2.

Comparative Example 9

The same procedures as in Example 10 were carried out with the following exception.

The dyeing temperature was changed from 170° C. to 140° C.

The test results are shown in Table 2.

Comparative Example 10

The same procedures as in Example 11 were carried out with the following exception.

The dyeing temperature was changed from 170° C. to 140° C.

The test results are shown in Table 2.

Comparative Example 11

The same procedures as in Example 12 were carried out with the following exception.

The dyeing temperature was changed from 170° C. to 130° C.

The test results are shown in Table 2.

Comparative Example 12

The same procedures as in Example 13 were carried out with the following exception.

The dyeing temperature was changed from 170° C. to 140° C.

The test results are shown in Table 2.

Comparative Example 13

The same procedures as in Comparative Example 12 were carried out with the following exception.

The CI Disperse Blue 56 was replaced by CI Disperse Red 60 having the molecular weight and the STL as shown in Table 2.

The test results are shown in Table 2.

Example 15

A plain weave fabric was prepared from poly-m-phenylene isophthalamide fiber spun yarns having a yarn count of 80s/2 and an individual fiber denier of 0.8, and available under the trademark Conex from Teijin Ltd. The resultant woven fabric had a warp density of 102 yarns/2.54 cm, a weft density of 6 yarns/2.54 cm, a basis weight of 125 g/m2 and a thickness of 0.24 mm.

The fabric was soured in an aqueous solution containing 1 g/liter of a nonionic detergent available under the trademark SCOUROL 400, from Kao, and 0.5 g/liter of sodium carbonate at a temperature of 90° C. for 20 minutes, and dried and heat-treated at a temperature of 190° C. for 2 minutes.

An aqueous dye dispersion having the following composition was prepared.

| | |
|---|---|
| Cationic dye (C.I. Basis Blue 47) (*)1 | 6% owf |
| Sodium nitrate | 2.5 g/liter |
| Acetic acid | 0.2 ml/liter |
| Liquor ratio: | 1:10 |

Dye (1) C.I. Basic Blue 47 having a molecular weight of 349 and an STL of 94%.

The heat-treated fabric was immersed and dyed in the aqueous solution.

During the dyeing procedure, the aqueous dye solution was heated at a temperature-raising rate of 2° C./minute from room temperature to 190° C. and then maintained at a temperature of 190° C. for 60 minutes.

The dyed fabric was subjected to a reduction cleaning procedure to remove a dye fraction adhered to the surfaces of the fibers. The reduction cleansing solution had the following composition:

| | |
|---|---|
| Sodium carbonate | 2 g/liter |
| Hydrosulfite | 2 g/liter |
| Temperature: | 80° C. |
| Time: | 20 minutes |

The test results are shown in Table 3.

TABLE 2

| Example | Item No. | Type of fiber | Dye CI Disperse | Dye Molecular weight | Dye STL (%) | Dye concentration (% owf) | Dyeing temperature (°C.) | K/S value | Washing fastness (class) | Light fastness (class) |
|---|---|---|---|---|---|---|---|---|---|---|
| Example | 5 | Technora | Blue 56 | 349 | 17 | 6 | 170 | 6.3 | 4 | 5 |
| | 6 | " | " | " | " | " | 190 | 8.4 | 3–4 | 5 |
| | 7 | PPS | " | " | " | " | 170 | 13.2 | 4–5 | 3 |
| Comparative | 3 | Technora | Blue 56 | 349 | 17 | 6 | 130 | 0.9 | — | 1 |
| Example | 4 | " | Blue 165 | 405 | 5 | " | 170 | 0.4 | — | 1 |
| | 5 | " | Blue 19 | 314 | 65 | " | 170 | 6.5 | 2–3 | 2 |
| Example | 8 | Technora | Red 60 | 331 | 2 | 6 | 175 | 6.3 | 4–5 | 5 |
| | 9 | " | " | " | " | " | 190 | 6.7 | " | 5 |
| | 10 | PEEK | Blue 56 | 349 | 17 | " | 170 | 14.5 | " | 3 |
| | 11 | PEI | " | " | " | " | 155 | 15.8 | " | 5 |
| | 12 | PEN | " | " | " | " | 155 | 15.2 | " | 5 |
| | 13 | Kevler | " | " | " | " | 185 | 11.0 | " | 4 |
| | 14 | " | Red 60 | 331 | 2 | " | 185 | 7.3 | " | 4 |
| Comparative | 6 | Technora | Blue 56 | 349 | 17 | 6 | 140 | 1.4 | 5 | 1 |
| Example | 7 | " | Red 60 | 331 | 2 | " | " | 1.5 | 5 | " |
| | 8 | PPS | Blue 56 | 349 | 17 | " | " | 4.2 | 4–5 | " |
| | 9 | PEEK | " | " | " | " | " | 3.6 | " | " |
| | 10 | PEI | " | " | " | " | " | 4.8 | " | " |
| | 11 | PEN | " | " | " | " | 130 | 5.2 | " | 3 |
| | 12 | Kevler | " | " | " | " | 140 | 2.9 | 5 | 1 |
| | 13 | " | Red 60 | 331 | 2 | " | " | 1.8 | 5 | 1 |

Comparative Example 14

In each of the comparative examples, the same procedures as in Example 15 were carried out except that the dyeing temperature was changed from 190° C. to 30° C.

The test results are shown in Table 3.

TABLE 3

| Example | Item No. | Type of fibers | Type of dye | Dyeing temperature (°C.) | K/S value | Washing fastness | Light fastness |
|---|---|---|---|---|---|---|---|
| Example | 15 | Convex | C.I. Basic Blue 47 | 190 | 14.2 | 4–5 | 3 |
| Comparative Example | 14 | Convex | C.I. Basic Red 47 | 130 | 2.0 | 2–3 | 1 |

We claim:

1. A method of dyeing a para-aramid fiber material comprised of a copolymer consisting of recurring p-phenyleneterephthalamide units and recurring 3,4,-oxydiphenylterephthal-amide units which method comprises immerse-dyeing said material in a dyeing liquid containing a dye dissolved or dispersed in an aqueous liquid medium and comprising at least one dye compound having a molecular weight of 330 to 400, at a dyeing temperature of at least 150° C. within a closed system.

2. The method as claimed in claim 1, wherein the dye compound exhibits a spectral transmission loss of 20% or less determined in such a manner that the dye is dissolved or dispersed at a concentration of 0.2% by weight in water; the pH of the resultant aqueous dye solution or dispersion was adjusted to a level of from 4 to 5 by adding an aqueous acetic acid solution to provide an original aqueous dye solution or dispersion; the original aqueous dye solution is diluted with water in the same volume as that of the original aqueous dye solution or the original aqueous dye dispersion is diluted with acetone in the same volume as that of the original aqueous, dye dispersion and the dispersed dye is dissolved in the resultant water-acetone mixture; the resultant diluted dye solution is subjected to a measurement of a spectral transmittance To in % thereof at a wave length at which the diluted dye solution exhibits a minimum spectral transmission; separately the original aqueous dye solution or dispersion is heat-treated in a closed system at a temperature of 150° C. for 60 minutes; the heat-treated aqueous dye solution is diluted with water in the same volume as that of the heat-treated aqueous dye solution or the heat-treated aqueous dye dispersion is diluted with acetone in the same volume with the heat-treated aqueous dye dispersion and the dispersed dye is dissolved in the resultant water-acetone mixture; the resultant heat-treated, diluted dye solution is subjected to a measurement of a spectral transmittance Tt in % thereof at a wave length at which the heat-treated, diluted dye solution exhibits a minimum spectral transmission; and the spectral transmission loss STL in % of the dye is calculated from the measured To and Tt in accordance with the equation (I):

$$STL\ (\%)=(To-Tt)/(100-To)\times 100 \quad \text{(I)}.$$

3. The method as claimed in claim 1, wherein the high heat-resistant synthetic fiber material is in the form of a fiber mass, yarn or fabric.

4. The method as claimed in claim 1, wherein the dyeing temperature is controlled to a level of 160° C. or more.

5. The method as claimed in claim 1, wherein the dye comprises at least one member selected from disperse dyes, cationic dyes, vat dyes, naphthol dyes, acid dyes, and mordant dyes.

* * * * *